US005924934A

United States Patent [19]

Hamilton

[11] Patent Number: 5,924,934

[45] Date of Patent: Jul. 20, 1999

[54] GOLF SWING PRACTICE CLUB WITH LASER POINTER

[76] Inventor: David Paul Hamilton, 113 Cowden St., Shannon, Miss. 38868

[21] Appl. No.: 09/095,388

[22] Filed: Jun. 10, 1998

Related U.S. Application Data

[60] Provisional application No. 60/049,804, Jun. 17, 1997.

[51] Int. Cl.[6] ..... A63B 69/36

[52] U.S. Cl. ..... 473/220; 473/409

[58] Field of Search ..... 473/220, 409

[56] References Cited

U.S. PATENT DOCUMENTS

| | | | |
|---|---|---|---|
| 2,080,608 | 5/1937 | Hannaford . | |
| 3,070,373 | 12/1962 | Mathews . | |
| 3,999,765 | 12/1976 | Bishop | 473/256 X |
| 4,456,257 | 6/1984 | Perkins . | |
| 4,903,968 | 2/1990 | Hargrave | 473/220 |
| 4,913,441 | 4/1990 | Freer . | |
| 5,082,282 | 1/1992 | Hernberg . | |
| 5,161,802 | 11/1992 | Daechsel . | |
| 5,269,528 | 12/1993 | McCardle, Jr. . | |
| 5,467,991 | 11/1995 | White, IV et al. . | |
| 5,544,888 | 8/1996 | Pellegrini . | |
| 5,759,110 | 6/1998 | Seibel et al. | 473/220 |

*Primary Examiner*—George J. Marlo
*Attorney, Agent, or Firm*—John V. Stewart

[57] ABSTRACT

A practice golf club that is short for carrying in luggage, but is weighted to a standard D3 swing weight. It has a shaft with first and second ends, with a first grip on the first end, a second grip on the second end, and a head projecting transversely from the second end for visual alignment of the club. It has a laser beam projecting from the second end of the shaft along the axis of the shaft. The golfer grips the first end of the shaft and swings the practice club, causing the laser to trace a line on the floor that provides feedback about the lower part of the swing. The golfer grips the second end of the shaft and swings the practice club, causing the laser to trace a line on the floor that provides feedback about the upper part of the swing. The golfer places the club horizontally across the thighs and observes the laser dot near a target to square the address stance.

3 Claims, 5 Drawing Sheets

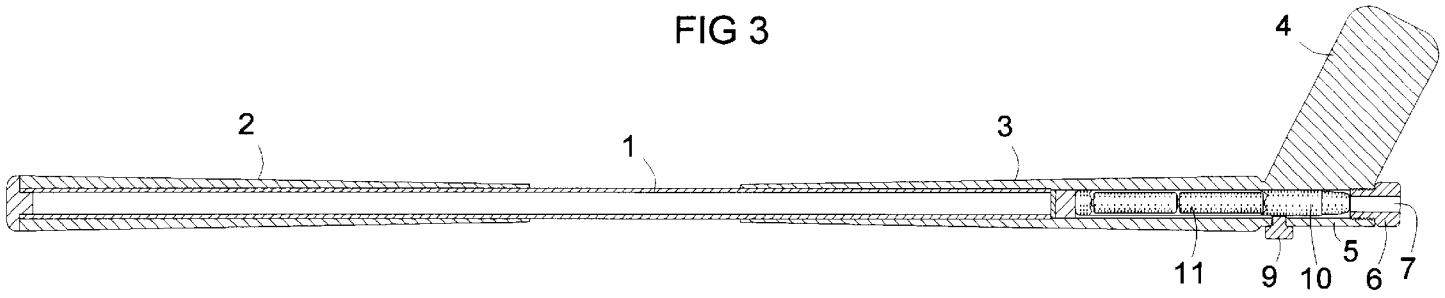
FIG 3
FIG 4
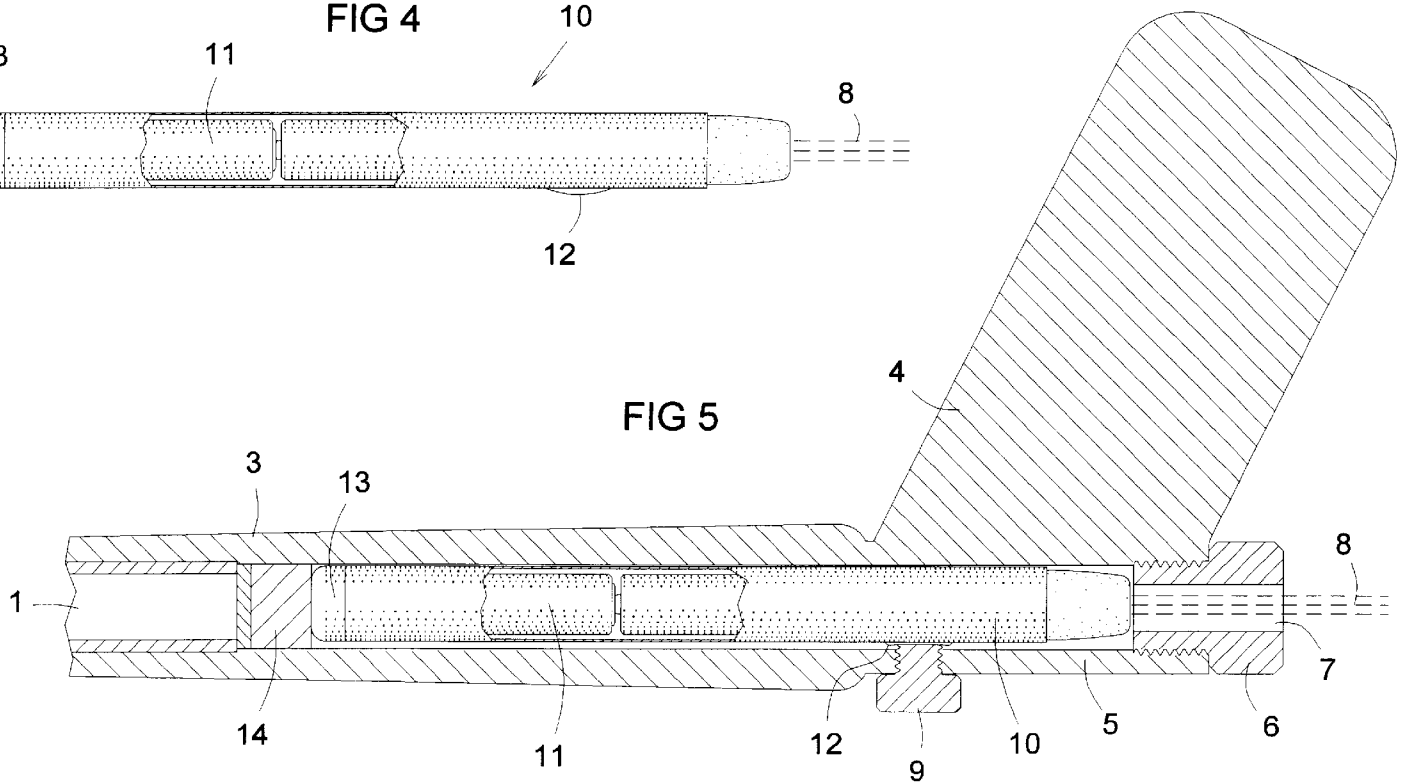
FIG 5

GOLF SWING PRACTICE CLUB WITH LASER POINTER

CROSS-REFERENCE TO RELATED APPLICATIONS

This application claims the benefit of U.S. Provisional Application No. 60/049,804 filed Jun. 17, 1997.

BACKGROUND OF THE INVENTION

1. Field of the Invention

This invention is in the field of golf clubs and golf swing practice aids.

2. Description of Prior Art

Practice clubs in the prior art include short clubs and clubs with projecting light beams. However, none of these has the combination of simplicity, convenience, completeness, and effectiveness of the present invention. Some examples of the prior art follow.

U.S. Pat. No. 5,161,802 (Daechsel) shows a shortened practice club with a light beam projecting from the head parallel to the shaft. This club illuminates the plane of the lower part of the swing only. It has no means to illuminate the plane of the upper back-swing and upper follow-through in a line that is visible to the user.

U.S. Pat. No. 5,544,888 (Pellegrini) shows a laser light attachment for the grip end of standard golf clubs, which projects a laser beam from the grip end of the shaft along the axis of the shaft. This device illuminates the plane of the upper back-swing and upper follow-through in a line that is visible to the user, but it does not illuminate the plane of the lower part of the swing. The club is full sized, so it cannot be used indoors with a standard ceiling height.

U.S. Pat. No. 5,467,991 shows a pair of light-emitting diodes (LEDs) that are attachable to a standard golf club, providing two light beams, which are projected parallel to the shaft in both directions. The beams are below the axis of the shaft, so they do not trace the swing plane of the shaft. The installed device is not compact, and thus cannot be used indoors with a standard ceiling height. Since the beams do not project from the ends of the shaft, it is impractical to place this device across the thighs to check the squareness of a golfers stance.

SUMMARY OF THE INVENTION

An object of the present invention is provision of a golf swing practice club which can be used indoors with a standard ceiling height. Another object is a practice club which traces the swing plane of the shaft on the floor via a light beam projecting along the axis of the shaft. Another object is a reversible club shaft, allowing the light beam to project from the grip end of the club to trace on the floor the plane of the upper part of the back-swing. Another object is a practice club which is compact and self-contained, and therefore convenient to carry or pack in a suitcase for travel. Another object is a practice club which can be placed across the thighs to project the beam in a way that shows the squareness of a golfers address stance.

These objectives are achieved with a practice golf club that is short enough to swing indoors, but is weighted to a standard swing weight. It has a head with a standard face angle for visual alignment practice, and has a laser light source, with the beam projecting from the head end of the shaft along the axis of the shaft. It has a standard golf club grip at each end of the shaft, making the shaft reversible in the hands to project the light beam in either direction for checking both the upper and lower parts of the swing. It can be placed across the users thighs to check the squareness of the stance via the location of the laser spot relative to the target line.

DRAWINGS

FIG. 3 is an overall sectional side view of the club of FIG. 1.

FIG. 4 is a partial cut-away side view of a laser pointer.

FIG. 5 is an enlarged sectional side view of the laser pointer chamber of FIG. 1.

REFERENCE NUMERALS

Figure 1:
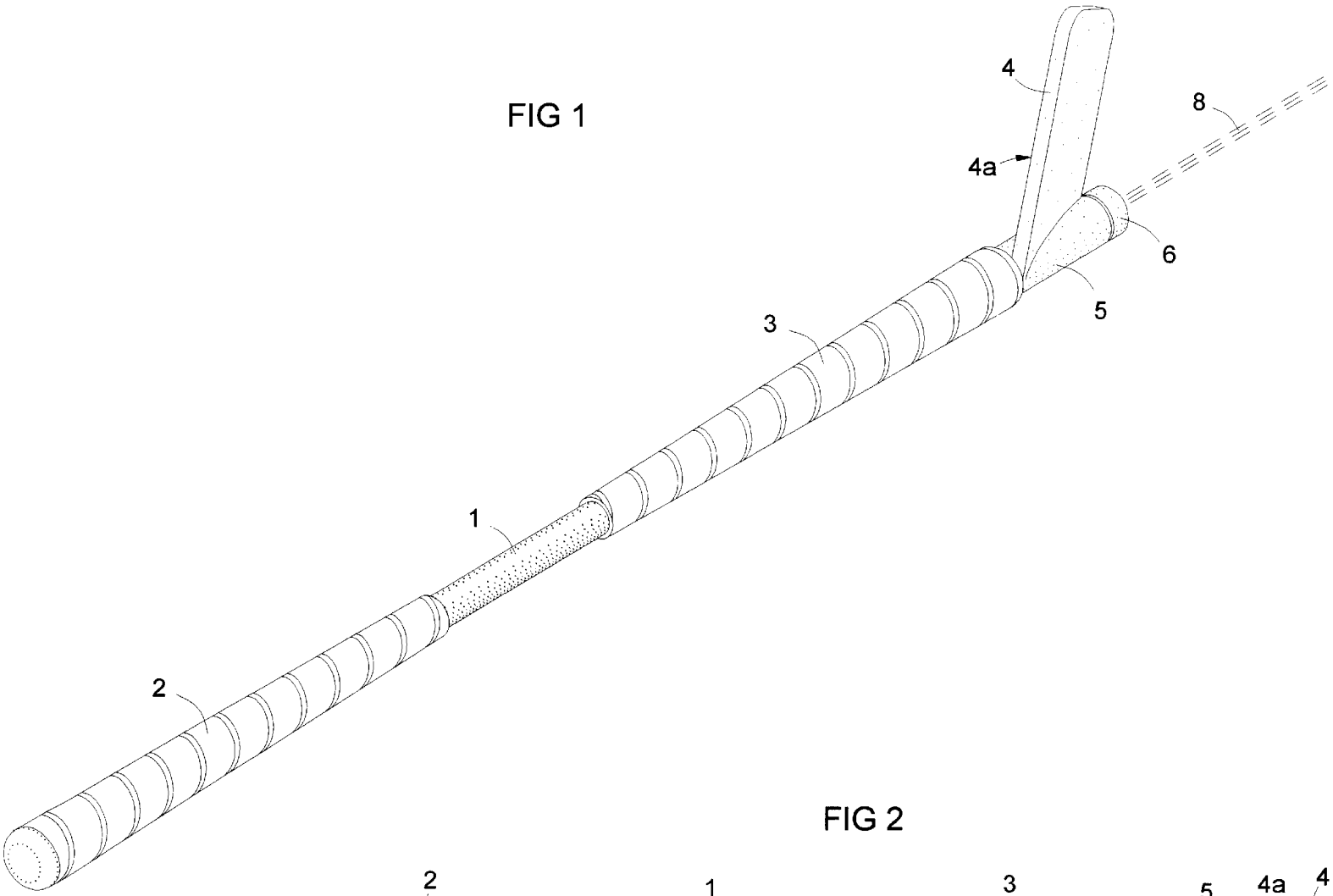
FIG. 1 is a perspective view of the club.

1. Shaft
2. First grip
3. Second grip
4. Head
4*a*. Head face
5. Laser pointer chamber
6. Laser end bolt
7. Hole in laser end bolt
8. Laser beam
9. Laser control bolt
10. Laser pointer
11. Batteries
12. Laser on/off button
13. Laser pointer end cap
14. Elastic compression pad or spring
15. End tube
16. Trace of laser beam on the floor or ground
17. Hands of user

DESCRIPTION OF THE PREFERRED EMBODIMENTS

This practice club allows golf swing practice indoors. It is short enough to fit inside travel luggage. Its shortness allows a golf swing to be performed indoors without hitting the ceiling or walls. A laser pointer (10) is installed in a chamber (5) in the end of the club. A laser beam (8) shines through a hole (7) in a bolt (6) that holds the laser pointer in the chamber. The beam shines away from the end of the club along the axis of the club shaft (1). The beam traces the plane of the golf swing along the floor, allowing the user to see if the swing is proper. The club is preferably weighted to a standard D3 swing weight for realism, by selection of materials and thicknesses as needed. The parts on the head end of the club are preferably made of a metal such as iron or steel for sufficient weight. The head (4) provides weight plus practice of visual alignment of the club head face **(4*a*)**.

A conventional self-contained laser pointer (10) is installed in a chamber (5). It includes standard batteries (11). The pointer can be removed from the chamber by unscrewing a laser end bolt (6). The end cap (13) of the laser pointer can then be removed to replace the batteries. Means is provided for operating the on/off switch of the laser from outside the chamber. If the laser has a switch that must be held on continuously during use, then a threaded control-bolt (9) as shown in the drawings is preferred. In FIG. 5 the laser switch (12) is depressed by the control bolt (9), which is threaded in the side of the laser chamber. The control bolt has a knurled head for finger operation. Other means may optionally be used, such as a slide switch. If the laser pointer has a switch that remains on or off, a hole (not shown) in the chamber can be provided for the user to reach the switch. A depression around the hole improves access to the switch. With these options, a conventional laser pointer can be selected for use in the product without modification.

Figure 2:
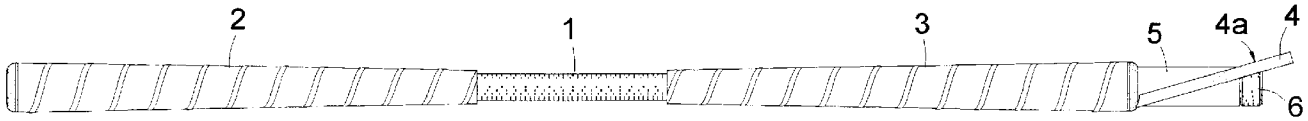
FIG. 2 is a top view of the dub of FIG. 1.
Figure 6:
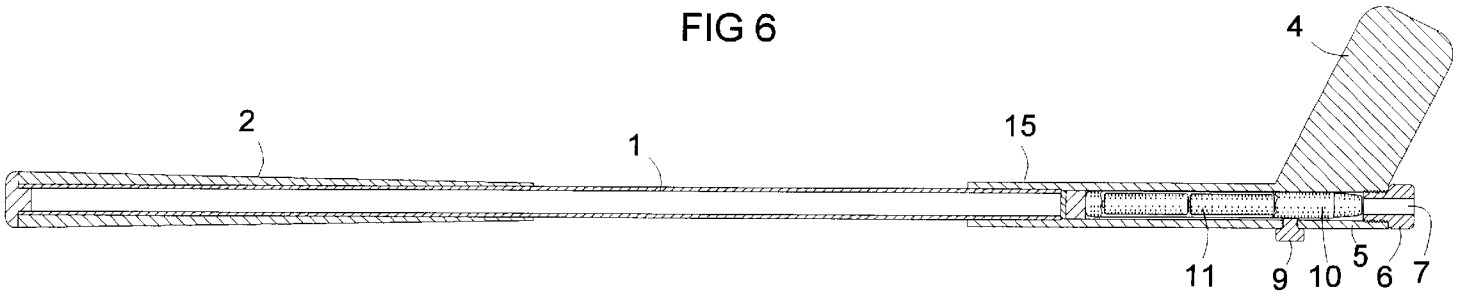
FIG. 6 is an overall sectional side view of the invention with a plain end tube (15)
Figure 7:
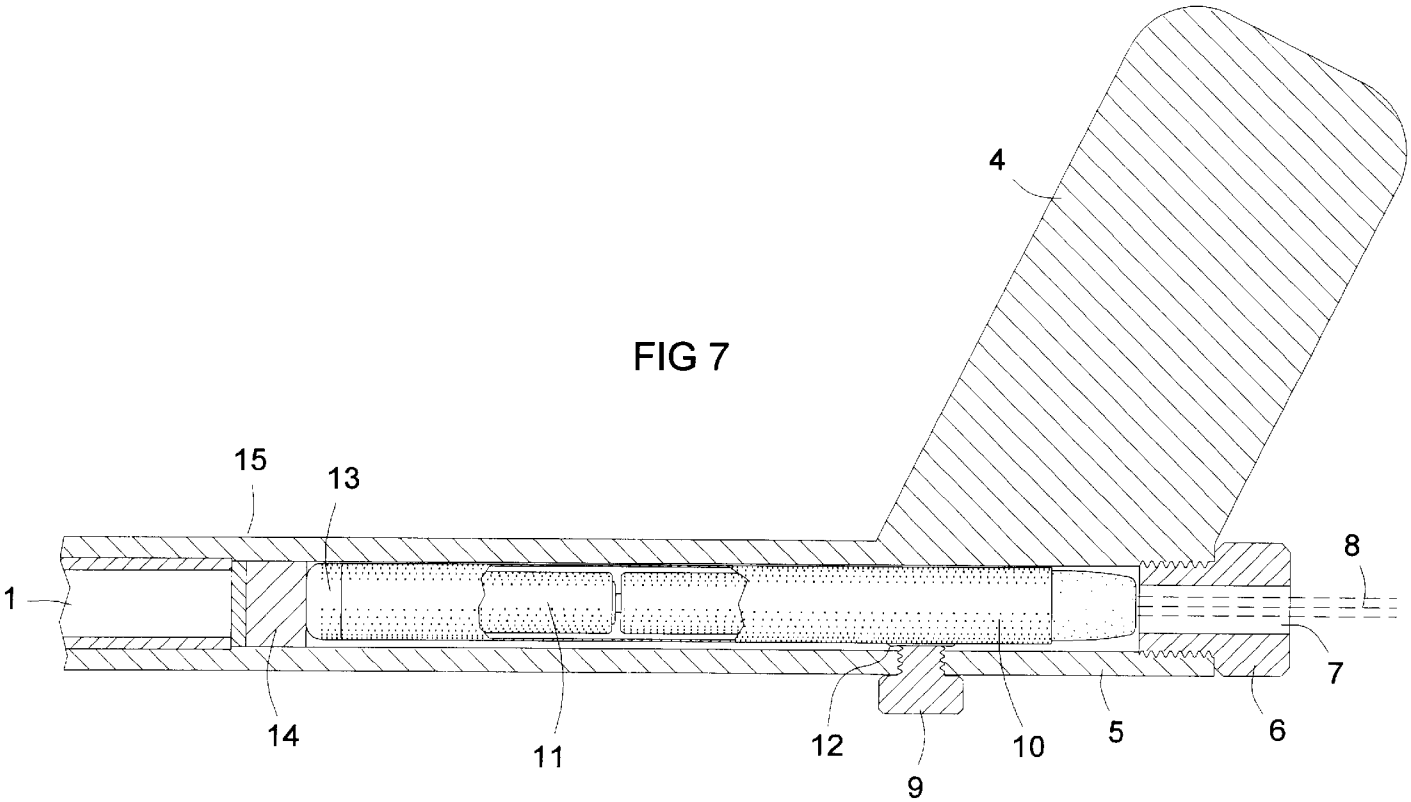
FIG. 7 is an enlarged sectional side view of the head end of FIG. 6.
Figure 8:
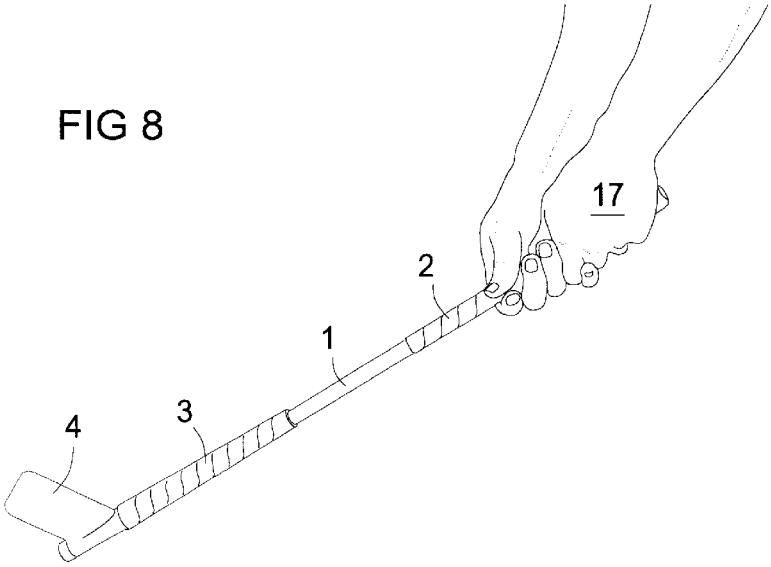
FIG. 8 is a side view of the club held by the first grip.
Figure 10:
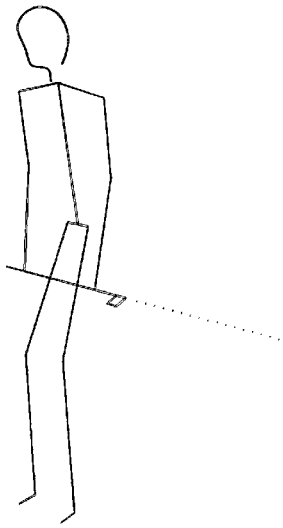
FIG. 10 shows the method of placing the club across the thighs to square the address stance.
Figure 9:
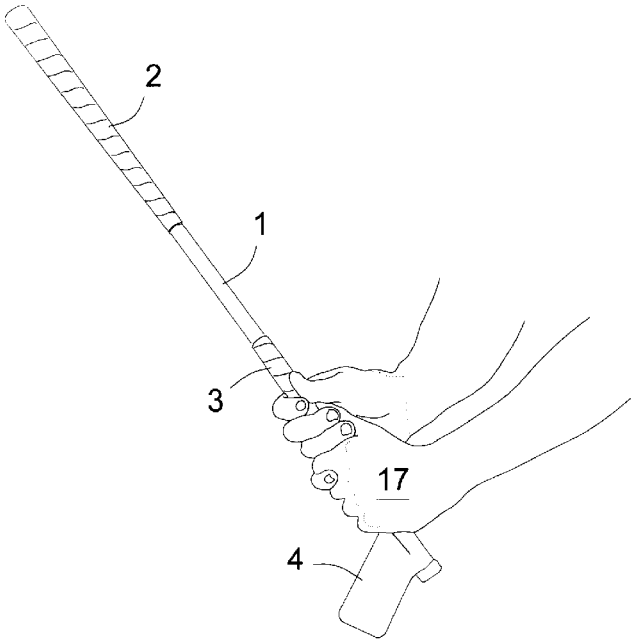
FIG. 9 is a side view of the club held by the second grip.
Figure 11:
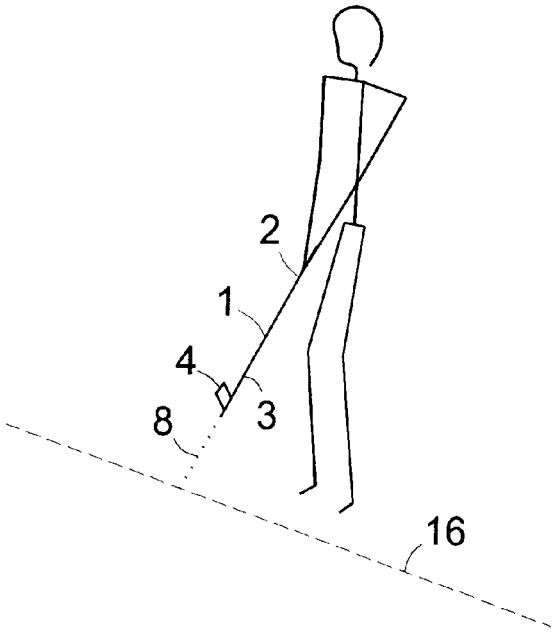
FIG. 11 shows the method of swinging the club by the first grip and observing the laser trace on the floor.
Figure 12:
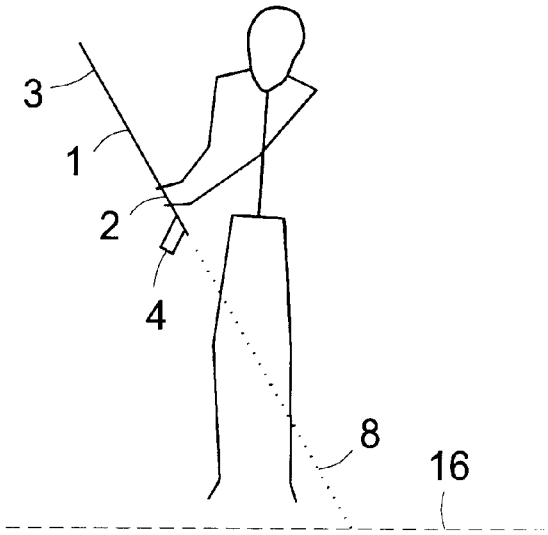
FIG. 12 shows the method of swinging the club by the second grip and observing the laser trace on the floor.

The goal of this training club is development of an "on plane" golf swing. The club should swing in a plane that includes the target line from the ball to the target. Thus, the laser spot should trace the target line during practice swings. To check the parts of the swing above waist level, the club is reversed by gripping the head end. A second grip (3) is preferably provided for this purpose as shown in FIGS. 1, 2, 3 and 5. With a reversed grip, the laser should trace the target line on the back-swing, and trace the backward extension of the target line on the follow-through.

The double grip design also allows the club to be used to accurately check a golfer's alignment, since the grip diameter is the same at each end of the club. To check the golfer's stance for squareness, the club is placed across the thighs. The laser beam should be parallel to the target line. Thus, the beam should illuminate a spot which is the same distance from the target line as the club when held across the thighs.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

I claim:

1. A golf swing practice club comprising:

a shaft having first and second ends and an axis;

each end of the shaft having a hand grip;

a head projecting transversely from the second end of the shaft, a battery powered laser light source in the shaft, generating a laser beam that projects from the second end of the shaft along the axis of the shaft; and the golf swing practice club weighted to approximately a golf club swing weight;

whereby a golfer can practice a golf stroke with the practice club indoors or outdoors, with the swing plane illuminated by the trace of the laser beam on the floor or ground, and the golfer can reverse the shaft to obtain illumination of either the back-swing plane or the lower swing plane.

2. A method for practicing a golf swing and stance by a user standing on a floor in a room with a wall, using a practice club comprising:

a shaft having first and second ends and an axis;

a first hand grip on the first end of the shaft;

a second hand grip on the second end of the shaft;

a head projecting transversely from the second end of the shaft; and, a laser beam projecting from the second end of the shaft, along the axis of the shaft;

the method comprising the steps of;

holding the club by the first grip, and practicing the motion of a golf swing;

viewing the path of the laser beam as reflected from the floor;

comparing the path of the laser beam to a desired path thereof, and modifying the swing to achieve the desired path;

holding the club by the second grip, and practicing the motion of the golf swing;

viewing the path of the laser beam as reflected from the floor; and, comparing the path of the laser beam to the desired path thereof, and modifying the swing to achieve the desired path.

3. The method of claim 2, further including the steps of;

taking a golf address stance;

placing the shaft of the practice club horizontally across the thighs;

viewing the laser beam as reflected from the wall;

comparing the reflection point to a desired point; and, modifying the address stance to achieve the desired reflection point.

* * * * *